United States Patent [19]

Gostomski, Jr. et al.

[11] Patent Number: 4,605,828

[45] Date of Patent: Aug. 12, 1986

[54] MEMBRANE KEYBOARD SWITCH MOUNTING

[75] Inventors: Dominic A. Gostomski, Jr., Versailles; Jerry G. Price, Paris, both of Ky.

[73] Assignee: International Business Machines Corporation, Armonk, N.Y.

[21] Appl. No.: 614,614

[22] Filed: May 29, 1984

[51] Int. Cl.[4] ..... H01H 13/70

[52] U.S. Cl. ..... 200/5 A; 200/159 B; 200/306

[58] Field of Search ..... 200/5 A, 159 B, 306, 200/86 R

[56] References Cited

U.S. PATENT DOCUMENTS

| | | | |
|---|---|---|---|
| Re. 31,332 | 8/1983 | Larson | 200/306 X |
| 3,860,771 | 1/1975 | Lynn et al. | 200/5 A |
| 4,046,975 | 9/1977 | Seeger, Jr. | 200/306 X |
| 4,118,611 | 10/1978 | Harris | 200/67 A |
| 4,362,911 | 12/1982 | Sears et al. | 200/5 A |
| 4,365,130 | 12/1982 | Christensen | 200/306 |
| 4,373,122 | 2/1983 | Frame | 200/5 A X |
| 4,375,018 | 2/1983 | Petersen | 200/5 A |
| 4,415,780 | 11/1983 | Daugherty | 200/306 |
| 4,485,279 | 11/1984 | Nakamura | 200/5 A |
| 4,489,227 | 12/1984 | Lamarche | 200/159 B X |

*Primary Examiner*—J. R. Scott

*Attorney, Agent, or Firm*—Laurence R. Letson

[57] ABSTRACT

A multilayer membrane switch structure is disclosed wherein the flexible membrane is fixedly attached to a support frame member by a pattern of adhesive regions, the regions positioned in locations corresponding to the switch locations of the structure. The adhesive engagement of the bottom surface of the membrane structure stabilizes the bottom electrical contact and, at the same time, leaves open regions between the adhesive regions which will accommodate air which is exhausted from the switch cavity through a hole formed in the bottom layer of the multilayered switch structure into communication with the open regions between the adhesive regions. Thus, the open regions act to exhaust the air in a switch cavity when the switch is activated.

13 Claims, 5 Drawing Figures

MEMBRANE KEYBOARD SWITCH MOUNTING

FIELD OF INVENTION

The invention relates to the field of membrane keyboards, the manufacture and mounting of membrane keyboard sandwiches onto a rigid support member or plate.

BACKGROUND OF THE INVENTION

Prior art attempts to mount the membrane keyboard sandwich structure onto a rigid support plate involved an extensive, substantially complete adhesive layer applied between the bottom surface of the membrane sandwich and the plate.

The complete or substantially complete adhesive layer used in the prior art to attach the membrane keyboard sandwich to the rigid support plate provides less than desirable results inasmuch as air bubbles may be trapped within the large adhesive region and effectively force the bottom layer of the sandwich away from the backing plate.

This results in a potential failure of the keyboard if the bubble is of sufficient size and location to force the bottom layer contact out of the plane of the support plate and thereby either cause an undesired contact between the contacts of that switch location or reduce the amount of distance between the two membrane mounted switch contacts thereby raising the possibility of unintentional contacts being made on an intermittent basis.

The problem of assembling the membrane keyboard sandwich onto the rigid support plate is further complicated when the sandwich is attached to the concave surface of a curved rigid support plate since forces may be transmitted to a key switch position through the membrane keyboard sandwich. This problem is caused by the inability to contact the entire adhesive layer to the support plate simultaneously when being assembled.

The venting of the individual cavities positioned between the electrical contacts of the membrane switch structure involved the forming of channels leading away from the cavities and passing into passages formed in the adhesive layer intermediate one membrane and the spacer layer and passing out to the atmosphere. U.S. Pat. No. 4,249,044 to Larson discloses such a series of channels for equalizing pressure interiorly of the switch with the atmosphere. Larson also discloses a chamber of air formed under the switch contact at the key switch position, which separates the bottom layer from its support member.

Larson further discloses the membrane switch structure attached to a support plate by an adhesive pattern which adheres the switch structure substantially completely around the periphery of the switch structure. Also adhesive, in a layer, is placed between the plate and the bottom layer of the switch structure but leaves regions of no adhesive under the switch site. This lack of adhesive attachment under the switch site leads to errors in that the bottom layer and its electrical contact may be displaced from the design location and not make and break as designed. Air pressure increase in the chamber beneath the switch position causes the upward movement of the electrical contact toward the electrical contact on the top layer of the switch structure, reducing the electrical contact separation or closing the switch.

SUMMARY OF THE INVENTION

The invention allows the use of glue spots beneath the switch sites without inhibiting the exhaustion of the air from the cavities at each switch site.

Adhesive is placed underneath each of the keyswitch positions to fix spacially the bottom electrical contact. A partial peripheral adhesive band acts to fix the sandwich relative to the plate and prevent spilled beverages or other fluid from entering the membrane sandwich, while the adhesive spots underneath the keyswitch positions stabilize the bottom contact of the keyswitch spacially with respect to the rigid support plate.

The problems described above may be overcome in part by utilizing an adhesive layer in the membrane sandwich which does not have a series of channels and passageways formed to exhaust the cavities located at the switch positions. The exhausting is accomplished by passing the air from the cavity through the bottom membrane layer toward the rigid support plate into a region which is not adhesively engaged with the membrane sandwich, and which is not underlying the electrical switch contact at the key switch position.

In order to accept the air exhausted from the cavity when the switch is made, the cavity is exhausted through the bottom layer into the region between the bottom layer and the rigid support plate. The rigid support plate is adhesively adhered to the bottom layer of the membrane sandwich by a pattern of precisely positioned adhesive spots. The bottom layer of the membrane sandwich is adhesively attached to the base plate around only three sides of its periphery so that the exhausted air pressure is freely equalized to atmospheric pressure.

The unglued areas are then capable of exhausting expressed air, from the cavities at the switch positions, to the atmosphere through the unglued side of the membrane sandwich. By utilizing the unglued areas in the region between the bottom membrane and the rigid support plate to exhaust air the need to provide elaborate venting channels is eliminated.

DETAILED DESCRIPTION OF THE INVENTION

Figure 1:
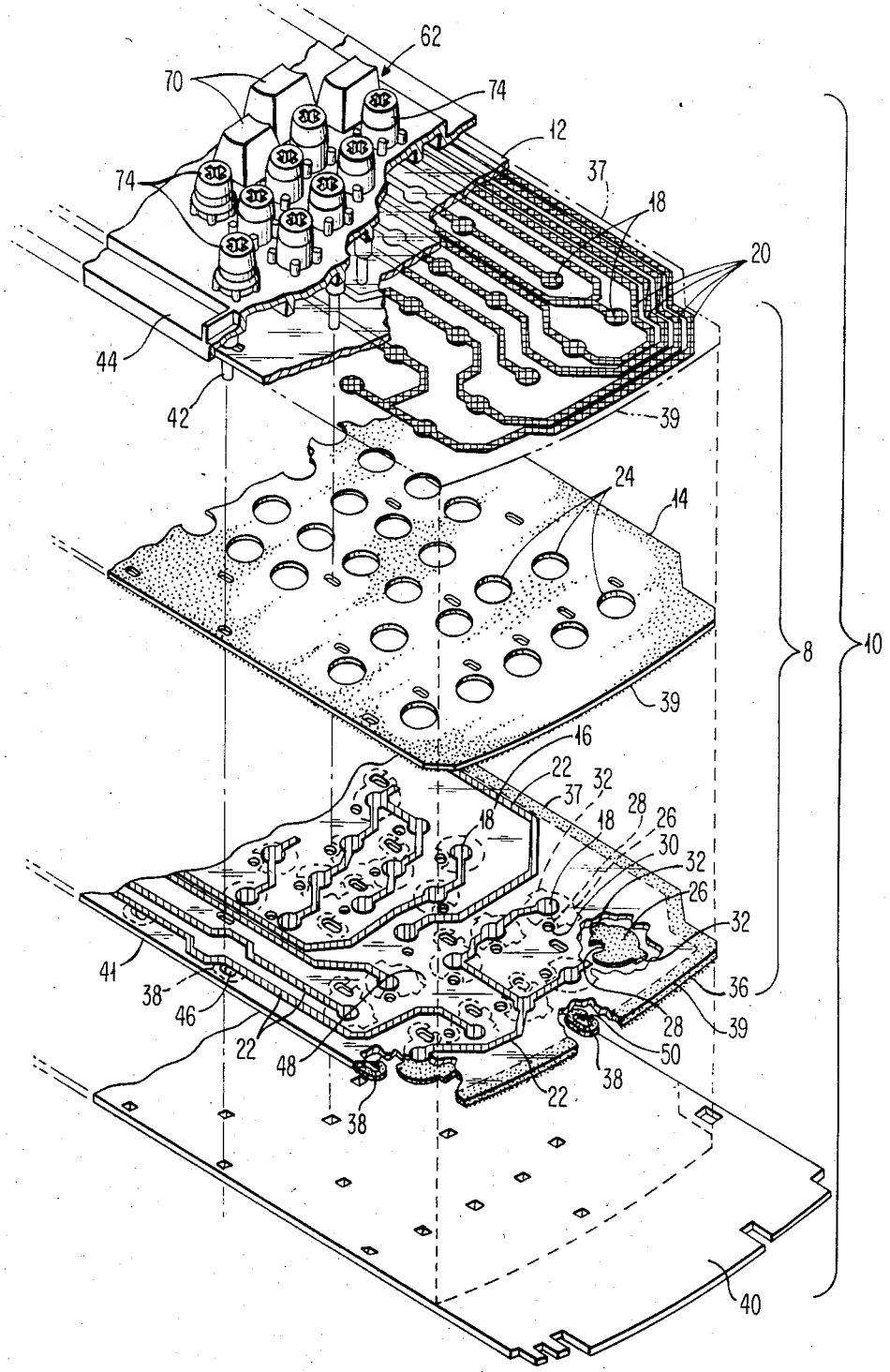
FIG. 1 is an exploded perspective view of a part of the membrane keyboard with the rigid support plate, and keybuttons and top frame included.

Referring to FIG. 1, the membrane keyboard structure 10 comprises a frame 44 supporting keybuttons 70, a three layer membrane sandwich 8 and a support plate 40.

The membrane sandwich 8 includes a top layer 12 which carries on the underside thereof a pattern of switch contacts 18 and conductors which act as drive lines 20 for the switch contacts 18. The switch contacts 18 and drive lines 20 are formed by silk screening a paste containing a polyester binder and a relatively high percentage of silver particles (commonly referred to as silver ink) onto a piece of non-conductive flexible sheet material such as "Mylar" which is the trademark of Du Pont Corporation for polyethylene terethylate. Other non-conductive plastic sheets can be used equally as well.

Adhesively adhered to the bottom surface of top layer 12 (the surface with the electrical contacts and conductors) is a spacer 14 which is a sheet of "Mylar" or similar material having a series of holes 24 punched therein corresponding in location to the switch contact 18 positions of the upper layer 12. Typically, both sides of this spacer 14 are coated with an adhesive.

The bottom layer 16 of the membrane sandwich 8 is a sheet of "Mylar" having deposited thereon, a series of switch contacts 18 and sense lines 22 through a silk screening process as described with respect to top layer 12.

Alternatively, a thick layer of adhesive may be selectively deposited between the bottom surface of layer 12 and the top surface of bottom layer 16 such that openings in the adhesive are in register with the switch contacts 18 or the top layer 12 and bottom layer 16. The thick layer of adhesive would serve in lieu of a separate spacer layer 14.

A switch closure occurs when the top layer 12 of the membrane sandwich 8 is deflected downward into hole 24 and the switch contact 18 on the top layer 12 contacts the switch contact 18 on the bottom layer 16, thereby establishing continuity between drive line 20 and sense line 22.

Figure 2:
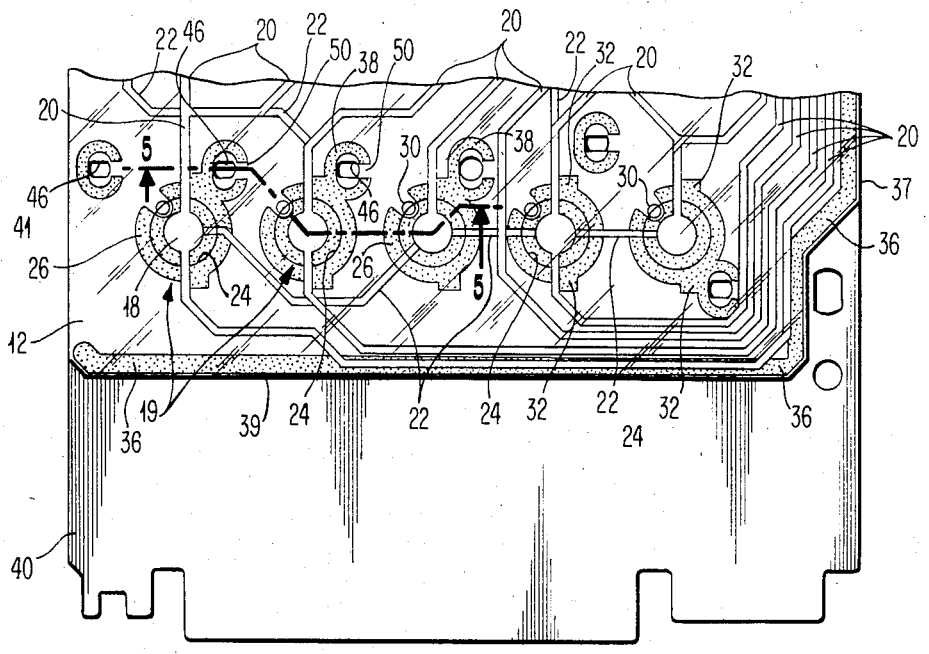
FIG. 2 is a plan view of the membrane switch structure showing the adhesive pattern.

During operation, a series of drive signals are sequentially provided over each of the drive lines 20. The sense lines 22 are simultaneously interrograted to determine whether a signal is present on any of the lines 22. If present, the identity of the sense line 22, together with the identity of the drive line 20 actuated with the sequential drive signal will define the switch position 19 at which the contacts 18 are made, as can be seen in FIG. 2.

Figure 3:
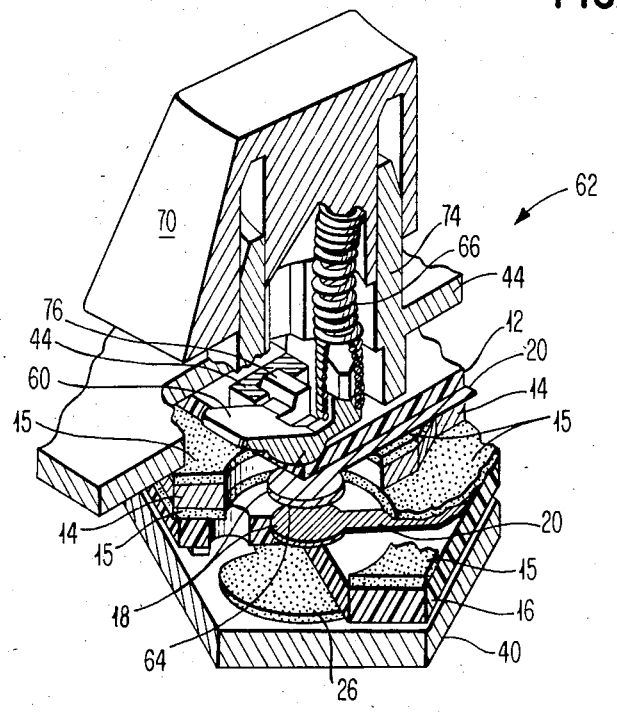
FIG. 3 is a detailed cut away perspective view of one typical key position on the membrane keyboard with the keybutton at rest.
Figure 4:
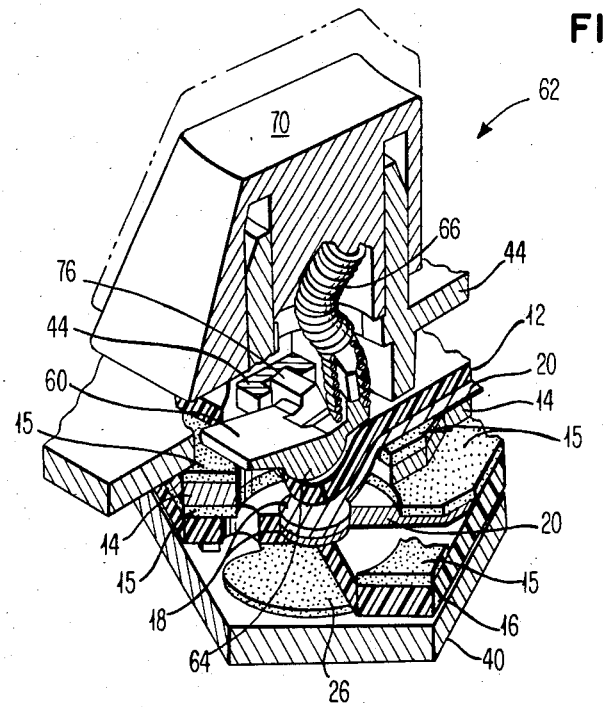
FIG. 4 is a detailed perspective cut away view of one typical key position on the membrane keyboard with the keybutton depressed.

To prevent the buckling of the bottom layer 16 and to accurately position the switch contacts 18 thereon relative to the rigid support plate 40, adhesive spots 26 are used. As shown in FIGS. 1 and 2 substantially surrounding and underlying each switch contact 18, on the back of the bottom layer 16 is a spot of adhesive 26 which has been selectively placed thereon. The spot of adhesive 26 is substantially circular in shape with a small sector 28, extending from the periphery of the region inward, being left without adhesive. In this sector 28, a small hole 30 has been punched extending completely through the bottom layer 16. In addition to the substantially circular spot of adhesive 26, small regions are extended outward from the circumference of the adhesive spot 26 appearing to form tabs 32, to form a base for a pivot plate 60 as seen in FIGS. 3 and 4.

To prevent the failure of the keyboard associated with the spilling of beverages on the keyboard 10 in the work environment, a band of adhesive 36 is deposited around the periphery on three sides of the bottom layer 16. The band of adhesive 36 extends across the top side edge 37 of the membrane sandwich 8 and down both sides 39. The keyboard 10 is typically positioned with the top edge 37 elevated, thus allowing the bottom edge to remain open while still protecting the keyboard structure 10 from such spills.

Other patterns of adhesive 38 are formed as incomplete annular or elongate shaped rings which serve to adhere the bottom layer 16 to the rigid support plate 40 in regions where a tenon 42 from the frame 44 of the keyboard will ultimately extend through and engage with the rigid support plate 40.

With the membrane sandwich 8 of the keyboard structure 10 fully assembled on the rigid support plate 40 by adhesively engaging each of the adjacent layers 12, 14, 16 to each other, the switch contacts 18 on the bottom layer 16 of the membrane sandwich 8 are firmly located relative to the rigid support plate 40. The areas between the adhesive spots 26 and intermediate the bottom layer 16 and the rigid support plate 40 act to allow the free flow to the atmosphere of the air which is expressed from the cavities 25 upon switch closure. The cavities 25 are formed by holes 24 and the top layer 12 and bottom layer 16.

Since the bottom edge 41 of the membrane sandwich 8 and rigid support plate 40 assembly is open to the atmosphere, there exists an unrestricted air flow to the atmosphere. Additionally, the holes 46 which are formed within the annular or elongated shaped open rings of adhesive 38 permit exhausting of the air from the unglued regions 48 between the adhesive spots 26 through the gap 50 in the ring 38 and out to the atmosphere through the hole 46 punched through the entire sandwich 8.

By firmly adhering the portion of the bottom layer 16 of the sandwich 8 to the rigid support plate 40 in a region beneath each of the switch contact 18 of the key switch position 19, the bottom switch contact 18 is then fixed rigidly insuring that the switch contact 18 is not forced upward by a trapped air bubble or other object trapped under bottom layer 16 during assembly, thereby causing a spurious signal to be generated by inadvertent closure of the contacts 18. The small hole 30 formed through the bottom layer 16 of the keyboard structure 10 for exhausting the displaced air from the cavities 25 of the membrane sandwich 8, together with the adhesive pattern underneath the bottom layer 18, eliminates the need for venting passages to be formed in the spacer and communicated with the outside atmosphere.

Figure 5:
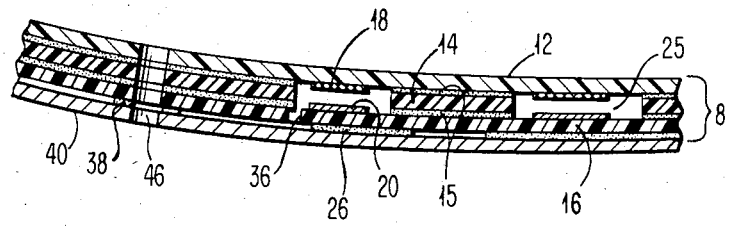
FIG. 5 is a sectional view through line 5—5 of FIG. 2 of the membrane switch structure as assembled and adhesively adhered to the rigid support.

As shown in FIGS. 1 and 5, the rigid support plate 40 is curved to position the keybuttons 70 such that their top surfaces conform to a surface described by the fingers of an operator as the fingers are extended to operate the keybuttons 70. This curvature makes the assembly of the membrane sandwich 8 and support plate 40 very troublesome when using the prior art complete layer of adhesive, but the assembly problems of entrapped air bubbles is alleviated when the spot pattern of adhesive is used.

Referring to FIG. 1, the tabular extensions 32 extending out from the otherwise substantially circular adhesive spots 26 insure that the membrane sandwich 8 is firmly adhered to the rigid support plate 40 in regions where a pivot plate 60, as in FIGS. 3 and 4, of the key assembly 62 rests so that no inadvertent buckling or bubble will prevent the actuator 60 from sitting squarely on the membrane sandwich 8. This insures the pivot plate 60 will function properly in forcing the contacts 18 together to cause the making of the contacts 18.

Referring to FIGS. 3 and 4, the structure of the actuator assembly 62 is illustrated. The frame 44 of the keyboard structure 10 supports a keybutton 70. The frame 44 includes surfaces which guide the keybutton 70 and these surfaces make up the chimney 74. The frame 44 also confines, underneath the frame 44, the pivot plate 60. The pivot plate 60 is formed with two pivot tabs 76 confined by the frame 44 and resting on the top of the top layer 12. The pivot tabs 76 are in register with the tabs 32 of the adhesive spot 26 and thus have solid surfaces to engage since the adhesive spots 26 and tabs 32 extend sufficiently outward past the hole 24 to adhere the membrane sandwich 8 to the rigid support plate 40 where there are no voids in the membrane sandwich 8. The firm footing for the pivot tabs 76 helps to insure proper operation of the pivot plate 60.

To deflect the top layer 12 and the associated switch contact 18 to contact the switch contact 18 of the bottom layer 16, the pivot plate 60 is formed with a protrusion 64 on the bottom side thereof for engaging the top layer 12 and forcing it downward through hole 74 to contact the switch contact 18 on the bottom layer 16.

The pivoting of pivot plate 60 is initiated by spring 66 which extends between the pivot plate 60 and the keybutton 70 as is fully described in U.S. Pat. No. 4,118,611 to Harris.

The switch contacts 18 are closed when the keybutton 70 is depressed. As the keybutton 70 travels downward, the spring 66 is compression loaded until it defleots and buckles. As it buckles, the moment caused by buckling pivots the pivot plate 60 about its pivot tabs 76 and forces the protrusion 64 downward to deflect the switch contact 18 on the top layer 12 into contact with switch contact 18 on the bottom layer 16, making continuity between a drive line 20 and a sense line 22.

When assembled, the keyboard frame is positioned on and conforms in curvature to the membrane sandwich 8 and rigid support plate 40 and is held in firm contact with the membrane sandwich 8 by tenons 42 which extend through holes 46 and then are hot upset or otherwise retained.

The regions of adhesive 26 stabilize the electrical contacts and leave open substantial regions between the bottom layer 16 and frame 40 to allow unrestricted air flow exterior to the membrane sandwich 8, thereby improving stability, manufacturability and reliability of the membrane sandwich 8.

The adhesive used in the membrane sandwich 8 is an acrylic adhesive and preferably ethyl hexyl acrylate, while the adhesive between the support plate 40 and the bottom layer 16 is a styrene butadiene rubber.

Typically the bottom layer 16 is approximately 0.007 inches thick and the top ayer 12 is approximately 0.003 inches thick. The two layers are separated by about 0.006 inches which is occupied by the spacer 14 and adhesive layers 15 thereon.

The selection of the adhesives is made solely on the physical properties thereof and not based on their chemical properties. Adequate adhesion to firmly adhere the adjacent surfaces is the primary consideration.

The regions of and locations and patterns and shapes of adhesive may be altered and modified without departing from the invention and are disclosed as the preferred embodiment of the invention.

We claim:

1. A keyboard comprising a matrix multilayer switch comprising:

a first flexible sheet with a first and second surface with electrical circuit paths and plural switch contacts deposited on said first surface thereof;

a second flexible sheet with electrical circuit paths and plural switch contacts deposited on a first surface thereof;

a spacer sheet with at least an aperture formed therein, positioned between said first and second flexible sheets and with said aperture aligned with portions of said electrical circuits on each of said sheets to form a passage through which said circuit on said second flexible sheet may contact said circuit on said first flexible sheet and with said first surfaces in face-to-face relation with faces of said spacer, at least a zone of adhesive interposed between said spacer and each of said flexible sheets to form a multilayer structure with each of said spacer and sheets restricted from movement with respect to each other in the plane of said spacer sheet; and a rigid support plate and adhesive engaging a first surface thereof, said multilayer switch adhesively attached to said rigid support plate, said adhesive engaging said rigid support plate comprising at least a spot of adhesive localized at and positioned between said support plate and said multilayer switch and adjacent said each of said switch contacts and engaging said second surface of said first flexible sheet, thereby stabilizing said electrical circuit path on said first flexible sheet, the substantial portion of the remainder of said second surface remaining without adhesive, and an actuator means aligned with and operable manually to actuate said multilayer switch, comprising a keybutton and a switch engaging member operable upon displacement of said keybutton to deflect switch contacts on said second sheet into contact with said switch contacts on said first sheet.

2. The keyboard of claim 1 wherein said rigid support plate is curved to a radius approximately the curve defined by the fingers of an operator as said fingers are extended to engage said keybuttons and where said plural switch contacts on said first sheet are fixedly positioned relative to said plate by said spots of adhesive between said plate an said first sheet.

3. The membrane switch structure of claim 2 wherein said spot of adhesive is substantially circular and is positioned between and aligned with said switch contacts and said support means.

4. The keyboard of claim 3 wherein said first flexible sheet has formed therein a hole extending from said first side to said second side thereof and communicating with said aperture and an area between said first flexible sheet and said rigid support plate where no adhesive exists.

5. The keyboard of claim 4 wherein said adhesive circular pattern comprises a sector, which has no adhesive, corresponding in location to the position of said hole, thereby creating a communication between said hole and said region of no adhesive between said first flexible sheet and said rigid support plate.

6. The keyboard of claim 2 wherein said multilayer structure is further adhesively attached to said support plate by adhesive deposited in a substantially continuous band adjacent three edges of said first flexible sheet and intermediate said sheet and said rigid support plate.

7. The keyboard of claim 3 wherein said multilayer structure is further adhesively attached to said rigid support plate by adhesive deposited in a substantially continuous band adjacent three edges of said first flexible sheet and intermediate said first sheet and said rigid support plate.

8. The keyboard of claim 4 further comprising additional regions of adhesive extending generally outward from said region of adhesive, thereby fixedly adhering said first flexible sheet to said rigid support plate in regions where objects may engage said membrane switch without causing one of said switch contacts to contact the other of said switch contacts.

9. The keyboard of claim 1 further comprising a frame for supporting said actuator means and said frame attached through said membrane switch and to said rigid support plate.

10. The keyboard of claim 9 wherein said frame further comprises tenons extending through said rigid support plate and deformed to prevent removal of said frame from said plate.

11. A keyboard comprising:

a membrane switch structure having a plurality of switch positions having a laminate of at least three layers and a rigid support member, with said member selectively adhered to said laminate with spots of adhesive positioned between said member and said laminate in areas corresponding to each of said switch positions, said middle layer of said laminate comprising a hole formed at the position corresponding to each of said switch positions, thereby defining in cooperation with the other two layers a cavity, and air exhausting means communicating between said cavity and the portion of space between said laminate and said support member having no adhesive adhering the laminate and said support member.

12. The keyboard of claim 11 wherein said spot of adhesive is substantially circular.

13. The keyboard of claim 12 wherein said laminate is further adhesively attached to said support member by adhesive deposited in a substantially continuous strip adjacent three edges of said laminate and intermediate said laminate and said support member.

* * * * *